United States Patent [19]

Nicolaisen et al.

[11] 4,020,435

[45] Apr. 26, 1977

[54] HINGED ARMATURE RELAY

[75] Inventors: Holger Nicolaisen; Finn Schnoor Andersen, both of Nordborg; Jens Peter Jensen, Augustenborg, all of Denmark

[73] Assignee: Danfoss A/S, Nordborg, Denmark

[22] Filed: Oct. 9, 1975

[21] Appl. No.: 620,871

[30] Foreign Application Priority Data

Oct. 28, 1974 Germany ..... 2451188

[52] U.S. Cl. ..... 335/275; 335/135

[51] Int. Cl.[2] ..... H01F 7/14

[58] Field of Search ..... 335/275, 128, 135, 203, 335/276

[56] References Cited

UNITED STATES PATENTS

| | | | |
|---|---|---|---|
| 3,548,139 | 12/1970 | Mendon et al. | 335/135 |
| 3,750,060 | 7/1973 | Pfenning | 335/135 |
| 3,763,448 | 10/1973 | Walters | 335/135 |

*Primary Examiner*—Harold Broome

[57] ABSTRACT

The invention relates to an electromagnetic contact switch relay assembly of the type having a magnetic coil. A yoke is attached to the coil. The yoke includes a flat plate portion with a knife edge at one end thereof. An insulated contact carrier is attached to the plate portion. An L-shaped armature has first and second legs with the corner therebetween having the inside thereof engaging the knife edge. The first armature leg has an inoperative position on the plate while at rest and an operative position while forming an acute angle with respect to the plate. The carrier has an end wall with resilient bifurcated portions engaging the outside of the armature corner and a rigid stop member therebetween for limiting the movement of the armature. A slide member for actuating contact switches is slidably mounted in the carrier in juxtaposition to the first armature leg for actuation in response to movement by the first armature leg. The carrier has a central wall with a central recess formed therein immediately above the corner of the armature. The second leg of the armature has a leg extending beyond the corner of the armature and into the recess for retaining the armature in its installed position.

1 Claim, 6 Drawing Figures

HINGED ARMATURE RELAY

The invention relates to a hinged armature relay comprising a magnetic coil, a yoke having a longitudinal web extending parallel thereto, an electrically inslating carrier fixed to the yoke for mounting at least one set of contacts, and an angular armature of which the inner angular edge is held by a depressor against an outer edge at the free end of the longitudinal web of the yoke with play permitting movement of the armature.

In such hinged armature relays, the knife bearing formed between the inner angular edge of the armature and the outer edge of the longitudinal web of the yoke results in a construction that is simple compared with a pivotal shaft and that operates with little friction. The electrically insulating carrier generally consists of several interconnected layers receiving the contact springs between each other and is fixed to the end of the longitudinal web of the yoke that is remote from the armature. In order that the armature retains its optimum position and does not become impermissibly displaced during travel, it is known to provide a sheet metal depressor engaging the outer angular edge of the armature. The small depressor plate projects through a recess in the armature and is there connected to the longitudinal web of the yoke by means of a screw. The assembly and correct location of the depressor plate is, however, cumbersome.

The invention is based on the object of providing a hinged armature relay of the aforementioned kind, which has a simpler construction and simplifies assembly.

This object is achieved in accordance with the invention in that the carrier and the depressor are combined by an intermediate section to form a one-piece attachment.

In this construction the depressor is part of a larger structural element, namely the attachment. This larger member is much easier to handle during assembly than a small sheet metal depressor; in particular the larger member can be more readily and more accurately located during assembly. Since only one attachment needs to be fixed to the longitudinal web of the yoke instead of two parts as hitherto, simplifications are also obtained in the work during attachment. The construction of the depressor from conventional electrically insulating materials, particularly plastics, is possible because it is adequately held and reinforced by the attachment.

It is particularly favourable if the depressor comprises at least one resilient tongue which lies against the outer angular edge of the armature with no more than slight play, and a fixed travel abutment having a somewhat larger spacing from the armature. By means of this sub-dividing of the depressor function, the resilient tongue is never overloaded because during larger spring deflections the travel abutment becomes effective.

In a prefered construction two resilient tongues with bevelled ends extend substantially perpendicular to the longitudinal web of the yoke and between them there is provided the travel abutment which has a first abutment face substantially perpendicular to the longitudinal web of the yoke and a second abutment face substantially parallel thereto. The bevelled ends of the resilient tongues permit the tongues to yield resiliently to movement of the armature parallel to the longitudinal web of the yoke as well as perpendicular thereto. In both directions, one of the two abutment faces is effective after a predetermined spring path.

In particular, the travel abutment can be formed by a block with a depression open towards the longitudinal web of the yoke, a lug formed on the armature being engaged in the depression. The depression forms the first abutment face and also prevents impermissible lateral movement of the armature; the underface of the block forms the second abutment face.

It is of advantage if the intermediate section comprises a supporting wall perpendicular to the longitudinal web of the yoke and a covering wall perpendicular thereto. This results in a T section which gives the intermediate section and thus the entire attachment a considerable amount of rigidity.

The resilient tongues may be parts of the end covering wall and may be separated by slots from the supporting wall. The spring characteristic of the tongues can be readily determined by the selection of the covering wall thickness, the tongue width and the slot length, with due regard to the plastic material that is used.

Further, the supporting wall may be centrally disposed and separate two contact sets from one another. The supporting wall therefore assumes an additional insulating function which permits the adjacent contact sets to be disposed comparatively closely to each other.

Further, projections can be formed on the supporting wall as abutments for contact springs. These abutments therefore form part of the one-piece attachment.

It is also recommended that the contact springs be self-clampingly insertable in laterally open slots of the carrier. In this way it is possible to extrude or injection mould a one-piece attachment and then simply insert in the attachment the few other components that are still to be included.

Assembly is facilitated if the attachment is fixed to the longitudinal web of the yoke by only one screw and located by at least one pin engaging in a hole in the longitudinal web of the yoke. By reason of the rigidity of the attachment it suffices to secure it by means of one screw. Because of the length of the attachment, a single pin will already result in a very accurate location in conjunction with the screw.

It is particularly favourable if a first pin is formed on a block, which is adjacent the depressor and engages through a recess in the armature, and engages in a cylindrical hole of the longitudinal web of the yoke, and if a second pin is formed near the screw connection and engages in an elongated hole of the longitudinal web of the yoke. The first pin leads to accurate centreing of the depressor and the second pin to its accurate alignment parallel to the outer angular edge of the armature. The elongated hole serves to receive tolerance differences in the manufacture of the attachment or the yoke. The securing screw then only serves to exert the necessary clamping force.

In a further development, the covering wall can be provided in a level portion with holes for receiving the pins of a second light attachment. The number of the contacts of the relay is then simply increased in that a second attachment is provided on the first attachment, whereupon both can be secured by means of one securing screw.

In a preferred embodiment the attachment comprises guides for a slide extending perpendicular to the web of the yoke, which slide is interposed between the armature and a contact spring prestressed in the opening direction of the armature. This slide therefore transmits the armature movement to the set of contacts, the attachment assuming the additional task of guiding the slide.

In particular, the slide can be U-shaped, overlap the supporting wall, have each limb guided in a first guide slot in the covering wall and in a second guide slot in an intermediate wall extending from the supporting wall, and carry at each limb an extension which on the one hand serves as a dog for the contact spring and on the other hand as an abutment for lying against the intermediate wall. The dogs can be disposed near the outer edge of each limb, and a recess complementary to the dog can adjoin the guide slot in the covering wall. The dog can therefore be simply pushed into the guides whereupon it is secured against dropping out and held in its position of rest by inserting the contact springs.

Further, the side of the slide remote from the armature can have a face for carrying along a second like slide in the second attachment. In this way the armature movement is also transmitted to the set of contacts of the second attachment.

The invention will be described in more detail with reference to the example illustrated in the drawing. In the drawing.

Figure 1:
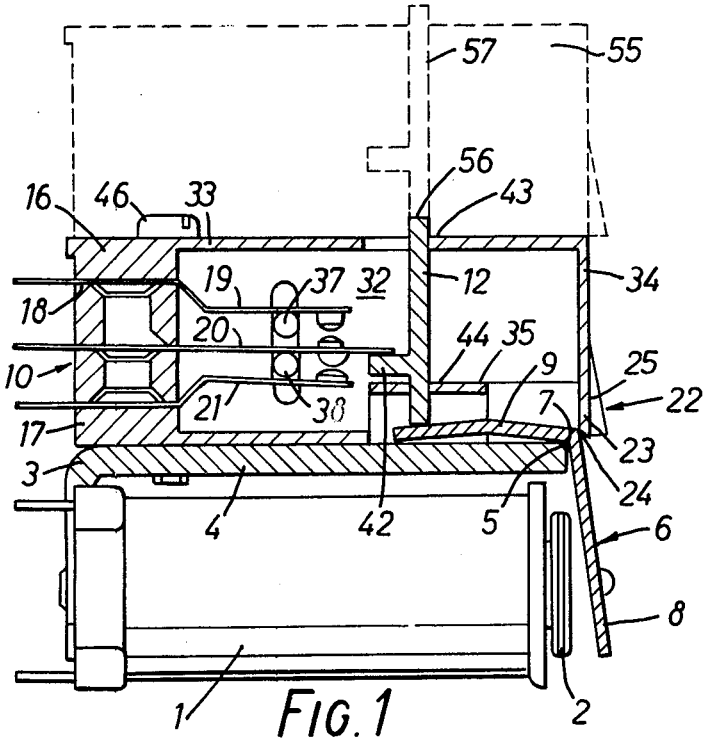
FIG. 1 is a side elevation, partly in section along the line A—A of FIG. 3, of a hinged armature relay according to the invention.
Figure 4:
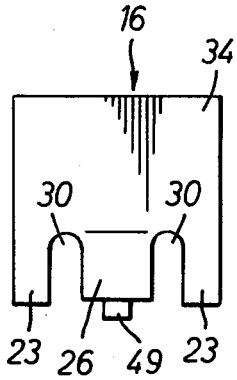
FIG. 4 is an end view from the right-hand side of the attachment.
Figure 2:
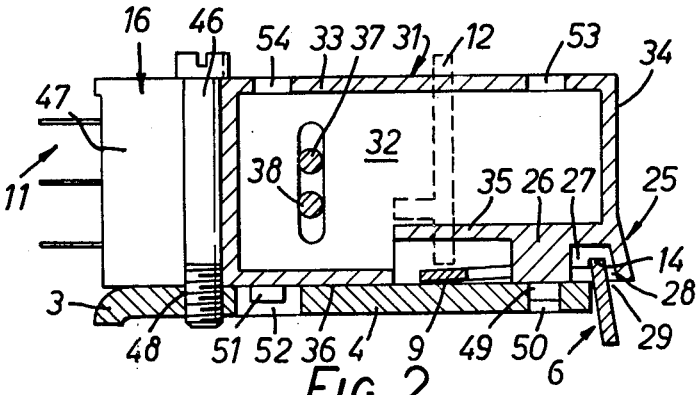
FIG. 2 is a section on the line B—B in FIG. 3.
Figure 5:
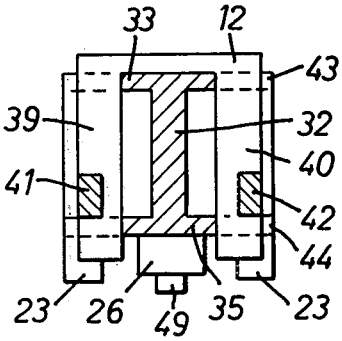
FIG. 5 is a cross-section on the line C—C in FIG. 3 with the slide inserted.
Figure 3:
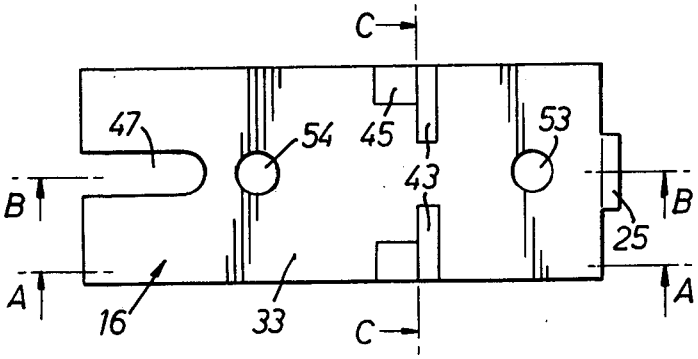
FIG. 3 is a plan view of the attachment of the hinged armature relay.
Figure 6:
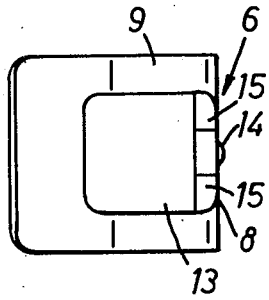
FIG. 6 is a plan view of the hinged armature.

FIG. 1 shows a magnetic coil 1 whith a core 2 and a yoke 3 of which the longitudinal web 4 extends parallel to the coil axis. The outer edge 5 at the free end of the longitudinal web 4 serves as a knife bearing for an angular hinged armature 6 of which the inner angular edge 7 lies against the outer edge 5. The armature has a first limb 8 for abutting the coil core 2 and a second limb 9 for actuating two sets of contacts 10 and 11 with the aid of a U-shaped slide 12. In the limb 9 there is a recess 13 (FIG. 6). A lug 14 projects therein and projects beyond the end walls 15 of the limb 8 in the extension thereof.

An attachment 16 is mounted on the longitudinal web 4 of the yoke. This attachment consists of an electrically insulating material that is so chosen that it can be injected or pressed in a mould and has certain spring properties, a temperature resistance up to 80° C and an adequate wear resistance. Plastics reinforced with glass fibres are particularly suitable for this purpose. It comprises a carrier 17 having three slots 18 which are open to one side and in which the contact springs 19, 20 and 21 of the set 10 of contacts are self-clampingly inserted. Three slots open to the other side serve to receive the contact springs of the second contact set 11.

At the other end, the attachment 16 comprises a depressor 22. This consists of two resilient tongues 23, which extend substantially perpendicular to the longitudinal web 4 of the yoke and have an inclined face 24 for lying against the outer angular edge of the hinged armature 6 with no more than slight play, as well as a travel stop 25. The latter has a depression 27 in a block 26. This results in a first abutment face 28, which extends substantially perpendicular to the longitudinal web 4 of the yoke and can co-operate with the lug 14, as well as a second abutment face 29, which extends substantially parallel to the longitudinal web 4 of the yoke end can co-operate with the end faces 15 if the armature should become excessively displaced with corresponding deformation of the resilient tongues 23. The depression 27 also ensures that the armature 6 cannot be displaced laterally. Slots 30 separate the resilient tongues 23 from the rigid block 26. Between the carrier 17 and depressor 22 there is a connecting section 31 which comprises a supporting wall 32 extending perpendicular to the longitudinal web 4 of the yoke, an upper covering wall 33 and end covering wall 34 at right-angles thereto, an intermediate wall 35 and a base wall 36. The carrier 17 and the depressor 22 are thus rigidly interconnected in the attachment 16. The supporting wall 32 separates the two sets 10 and 11 of contacts from each other. Formed on it at both sides there are also each of two projections 37 and 38 which serve as an abutment for the prestressed contact springs 19, 20 or 21, respectively.

The slide 12 is of U shape and carries at each of its limbs 39 or 40 a dog 41 or 42, respectively, which on the one hand lifts the central contact spring 20 on actuation by the armature 6 and on the other hand prevents the slide from falling out in the downward direction by lying against the intermediate wall 35 before the attachment 16 is secured to the yoke 3. The slide 12 is provided with first guide slots 43 in the covering wall 33 and with second guide slots 44 in the intermediate wall 35, in which the limbs 39 and 40 of the slide 12 are received. Adjoining the slots 43 there are recesses 45 adapted to the dogs 41, 42 in size and position so that the slide 12 can be introduced through the covering wall 33 and then locked by sliding in the contact spring 20.

To secure the attachment 16 to the yoke 3 there is a single screw 46 which engages through an elongated slot 47 of the attachment and engages in a tapped hole 48 of the yoke 3. In addition, the underside of the attachment 16 near the depressor 22 is provided with pin 49 which fits in a socket 50 of the yoke 3 and, in the vicinity of the screw 46, a second pin 51 which engages in an elongated hole 52 in the yoke 3 having the same width as the pin diameter. By means of the pins 49, 51, the attachment has an accurately defined position, especially in the region of the depressor 22. The screw 46 merely to apply the securing force. Since the attachment is very rigid, this securing force is also effective in the region of the depressor.

In the upper covering wall 33 there are two holes 53 and 54 corresponding to the pins 49 and 51. Consequently, and as shown in broken lines in FIG. 1, a second attachment 55 identical with the attachment 16 can be placed on the upper covering wall 33 so that a larger number of relay contacts is available. The upper face 56 of the slide 12 projects from the upper covering wall 33 to such an extent that it can carry along a like slide 57 in the second attachment 55. To secure the two attachments, one requires merely one screw 46 of twice the length. Similarly, even more like attachments can be stacked on one another.

We claim:

1. An electromagnetic contact switch relay assembly comprising a magnetic coil, a yoke attached to said coil having a flat plate portion with a knife edge at one end thereof, an insulated contact carrier attached to said plate portion, a generally L-shaped armature having first and first and second legs with the corner therebetween having the inside thereof engaging said knife edge, said first leg of said armature having an inoperative position on said plate while at rest and an operative position while forming an acute angle with respect to said plate, said carrier having an end wall with resilient bifurcated portions engaging the outside of said armature corner and a rigid stop member therebetween for limiting the movement of said armature, a slide member for actuating contact switches slidably mounted in said carrier in juxtaposition to said first armature leg for actuation in response to movement by said first armature leg, said carrier having a central wall with a central recess formed therein immediately above said corner of said armature, said second leg of said armature having a lug extending beyond said corner and into said recess for retaining said armature in its installed position.

* * * * *